US005285731A

United States Patent [19]

McIntyre

[11] Patent Number: 5,285,731

[45] Date of Patent: Feb. 15, 1994

[54] LIGHTWEIGHT FIBERBOARD PALLET

[75] Inventor: A. Ross McIntyre, Salt Lake City, Utah

[73] Assignee: Packaging Corporation of America, Evanston, Ill.

[21] Appl. No.: 919,132

[22] Filed: Jul. 23, 1992

[51] Int. Cl.[5] ..... B65D 19/00

[52] U.S. Cl. ..... 108/51.3; 108/56.3

[58] Field of Search ..... 108/51.3, 51.1, 56.1, 108/56.3

[56] References Cited

U.S. PATENT DOCUMENTS

| | | | |
|---|---|---|---|
| 2,611,569 | 9/1952 | Coleman et al. | 108/51.3 |
| 2,716,532 | 8/1955 | Wysong, Jr. et al. | 108/51.3 X |
| 2,928,638 | 3/1960 | Parker | 108/51.3 |
| 3,041,029 | 6/1962 | Brown | 108/51.3 |
| 3,131,656 | 5/1964 | Houle | 108/56.3 X |
| 3,464,370 | 9/1969 | Martin | 108/51.3 |
| 3,557,719 | 1/1971 | Gielas | 108/51.3 |
| 3,602,158 | 8/1971 | Skaggs | 108/51.3 |
| 4,228,744 | 10/1980 | Moore . | |
| 4,296,860 | 10/1981 | Hsu et al. . | |
| 4,378,743 | 4/1983 | McFarland . | |
| 4,390,154 | 6/1983 | Ostler et al. . | |
| 4,391,202 | 7/1983 | Carter et al. . | |
| 4,487,136 | 12/1984 | Beckway . | |
| 4,760,922 | 8/1988 | Northgrave . | |
| 5,069,338 | 12/1991 | Grigsby . | |

FOREIGN PATENT DOCUMENTS

| | | | |
|---|---|---|---|
| 2173768 | 10/1966 | United Kingdom | 108/51.1 |
| 2026431 | 2/1980 | United Kingdom | 108/56.3 |

*Primary Examiner*—Jose V. Chen

*Attorney, Agent, or Firm*—Arnold, White & Durkee

[57] ABSTRACT

A corrugated paperboard pallet includes a base member having first and second pairs of opposite sides and a plurality of column-shaped support members secured to the bottom side of the base member. The support members have apertures at opposing ends for receiving flaps from the base member and support blocks, so as to secure the support members to the base member and to provide additional strength to the pallet, respectively. This pallet design can be conveniently shipped and stored until ready for use, and can be entirely assembled by the user.

18 Claims, 4 Drawing Sheets 90
91
93
42
30e
18
30d
28
30c
38
30
30b
30a
42
46
26
38
42
30e
30d
22
30c
30b
30a
14
86
74
58
66
34a
34
54
78
70
62
82
34b
34c

LIGHTWEIGHT FIBERBOARD PALLET

FIELD OF THE INVENTION

The present invention relates generally to pallets and, more particularly, to pallets which include fiberboard as part of their contruction.

BACKGROUND OF THE INVENTION

Pallets are portable platforms which are typically used for handling, storing or otherwise moving many different materials such as boxes, packages and the like. These pallets are constructed from a variety of materials including lumber, plastic and lignocellulose-containing materials such as wood chips and wood fibers.

Pallets constructed of lumber are widely used for transporting heavy materials, because of the strength of lumber. For example, hard woods such as oak are commonly used to construct pallets intended for transporting steel. Other types of lumber are used for pallets intended for transporting relatively light products such as perishables and most retail products.

Pallets constructed of plastic are often made from recyclable material for ecological reasons. The strenth of plastic pallets depends on a number of factors, including the type of plastic(s) and the molding process used to form the pallet. In the case of recyclable material, additional factors include the purity, consistency and grade of recyclable plastic(s) selected as the basis.

Pallets constructed of a lignocellulose-containing material are often manufactured by adding certain binders to the lignocellulose-containing material and then compression molding this mixture to form a pallet having the desired shape and dimensions.

Unfortunately, pallets constructed from wood, plastic and/or lignocellulose-containing materials are generally heavy, and costly to manufacture and transport. For example, the manufacture of the lignocellulose-type pallet is fairly difficult given that a suitable binder must be added to the lignocellulose-containing material and this mixture must then be compression molded to form a pallet of the desired shape and dimensions. Wood pallets are undesirable because of their tendency to damage product via wood splinters.

Furthermore, each of the above pallet types are bulky and difficult to ship and to store until ready for use; and, once the pallets have been formed, the style, size and strength of the pallet cannot be changed.

Fiberboard, such as corrugated paperboard, material is widely used throughout the packaging industry to form shipping containers for a wide variety of products. In addition, fiberboard has been used to form containers having bottoms formed from lumber or the previously discussed lignocellulose-containing materials and having wood-reinforced sidewalls for added support. Unfortunately, each of these structures is heavy and, therefore, diffucult and expensive to transport.

SUMMARY OF THE INVENTION

The present invention provides an easily and inexpensively manufactured fiberboard pallet comprising a base member and a set of elongated column-shaped support members secured to the base member.

In one embodiment of the present invention, a corrugated paperboard pallet includes a base member having flap extensions foled for securing a plurality of support members to the underside of the base member.

In another embodiment of the present invention, the invention provides a paperboard pallet comprising a base member having first and second pairs of opposite sides, a plurality of support members secured to the base member, the support members having first and second end having first and second apertures therein and extending between the first pair of opposite sides and flaps extending from the first pair of opposite sides of the base member for securing the support members to the base member. The flaps extend into the apertures to secure the support members to the bottom side of the base member.

This pallet design can be conveniently shipped and stored until ready for use, and can be entirely assembled by the user.

Variations of the above embodiments, and the methods by which they are constructed, are discussed in detail below.

BRIEF DESCRIPTION OF THE DRAWINGS

Other objects and advantages of the invention will become apparent upon reading the following detailed description and upon reference to the drawings in which.

Figure 1A:
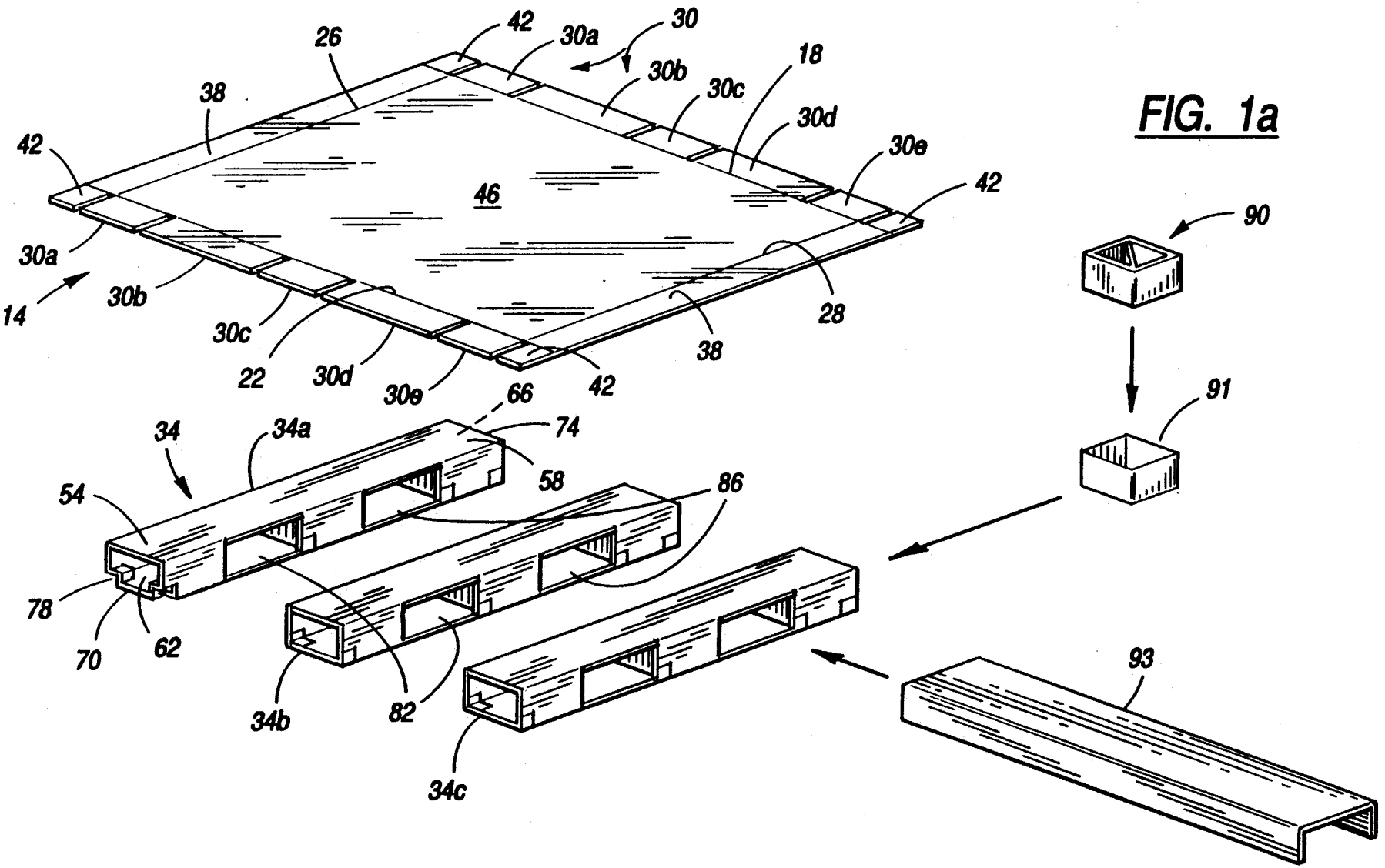
FIG. 1*a* is an illustration of the bottom of a pallet, according to the present invention, shown before final assembly.

While the invention is susceptible to various modifications and alternative forms, specific embodiments thereof have been shown by way of example in the drawings and will be described in detail. It should be understood, however, that the described embodiments, and the phraseology and terminology used in connection therewith, are not intended to limit the invention to the particular forms described. On the contrary, the intention is to cover all modifications, equivalents, and alternatives falling within the spirit and scope of the invention as defined by the appended claims.

DETAILED DESCRIPTION OF THE PREFERRED EMBODIMENT

Figure 1B:
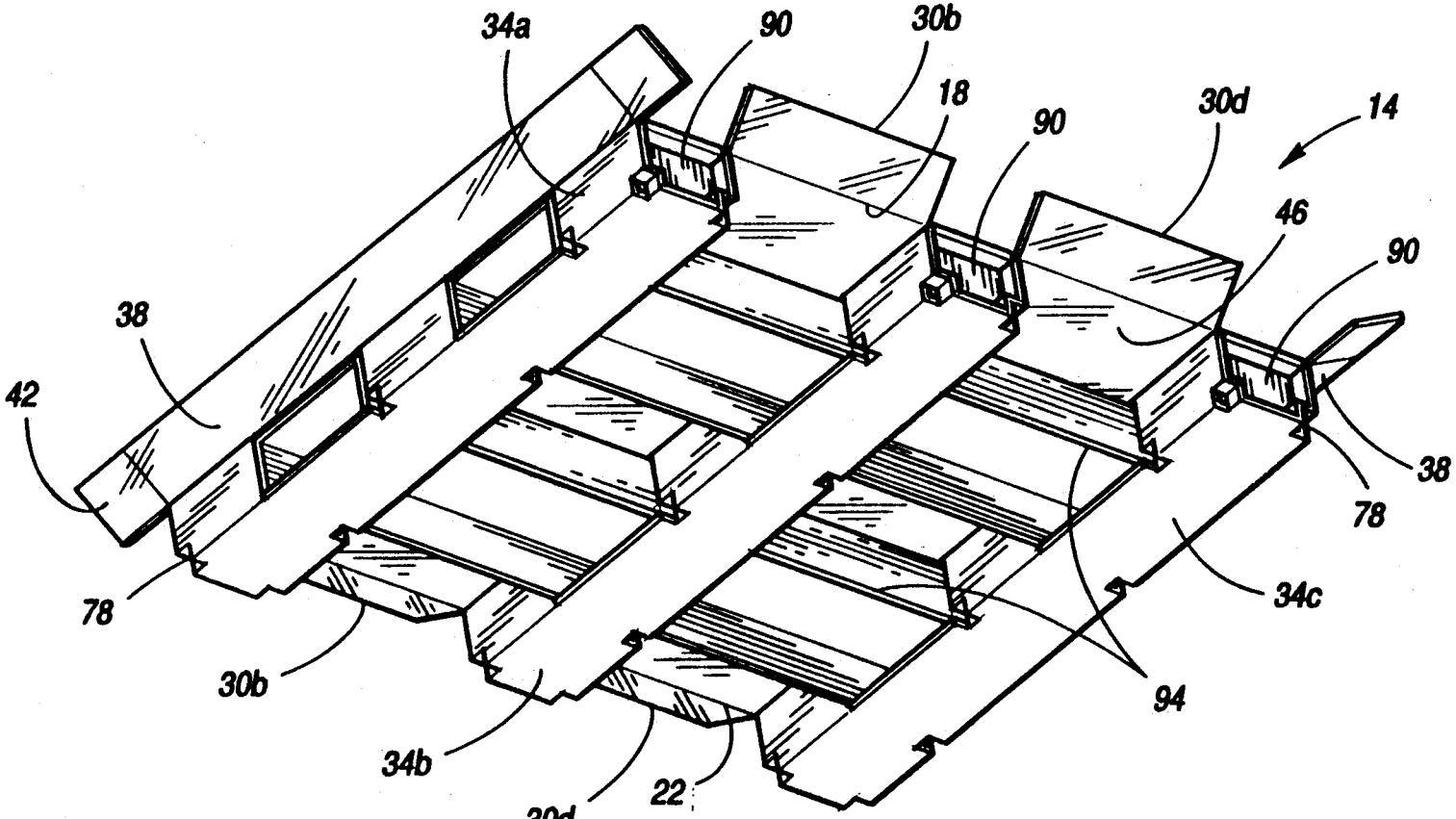
FIG. 1*b* is an illustration of the pallet of FIG. 1*a*, also from a bottom-side perspective and according to the present invention, shown during final assembly.

Turning now to the drawings, FIGS. 1*a* and 1*b* illustrate a bottom-side perspective view of a lightweight pallet 10, in accordance with the present invention, which can be completely assembled by the user, is completely recyclable, can be stored "flat" until assembled and can be easily modified to accommodate applications requiring transportation of relatively heavy or lightweight products. FIG. 1*a* shows the pallet 10 just before final assembly, and FIG. 1*b* shows the pallet 10 assembled.

Overall Pallet Construction

The pallet 10 includes a rectangular base member 14 having opposing sides 18, 22 and 26, 28. Sides 18 and 22 of the base member 14 have flaps 30 extending therefrom. The flaps 30 are utilized to secure support members 34*a*, 34*b* and 34*c* to the bottom surface 46 of the base member 14. The number of flaps extending from sides 18 and 22 may vary depending upon the desired application. Flaps 30*a* are inserted into apertures 62 and 66 on support member 34*a*, flaps 30*c* are inserted into apertures 62 and 66 on support member 34*b*, and flaps 30*e* are inserted into apertures 62 and 66 on support member 34*c*. Flaps 30*b* and 30*d* are not used and can be removed.

Sides 26 and 28 are each shown to include an end piece 38 extending therefrom. Although the end pieces 38 are not required, the end pieces 38 provide additional support and protect the support members 34 that are secured to the base member 14, adjacent the sides 26 and 28. The end pieces 38 also include an optional wing member 42, which insert into the apertures 62 and 66, to further assist in securing the support members 34 to the base member 14.

The support members 34 are rectangular in shape and include first and second ends 54 and 58, which have respective apertures 62 and 66 therein. The apertures 62 and 66 are defined by respective side walls 70 and 74. The side walls 70 and 74 include fold-in tabs 78 which extend in front of apertures 62 and 66 to contain support blocks 90, a shown in FIG. 1*a*.

The support members 34 further include a cavity, preferably two cavities 82 and 86, extending therethrough and positioned between the first and second ends 54 and 58 of the support member 34.

The number of support members 34 utilized in the construction of the pallet 10 can vary, depending upon the application.

The support blocks 90, which are optional, are positioned inside of the support members 34 through apertures 62 and 66. While other shapes and constructions can be used for this application, rectangularly shaped blocks 90 constructed of corrugated paperboard are generally adequate for most applications. Other suitable materials such as wood and foam may also be used. Wood blocks provide superior strength.

In the embodiment shown in FIGS. 1*a* and 1*b*, the sidewalls 70 or 74 defining apertures 62 and 66 respectively include fold-in tabs 78, which are pressed outwardly to allow insertion of the support block 90. The tabs 78 are then retracted to a position at front of the apertures 62 and 66 to assist in securing the blocks 90 therein.

In applications requiring additional pallet strength, a reinforcing member 93 is inserted through the cavities 82 and 86 in each of the support members 34*a*, 34*b* and 34*c* to provide added strength to the pallet 10. Although not required when used, the reinforcing member 93 is preferably a three-sided (bottom side removed), rectangularly shaped corrugated paperboard material, which includes apertures at each end thereof to permit fork-lift tines access to the bottom side of the pallet from the opposing sides 26 and 28. Alternatively, the three-sided reinforcing member 93 can include a stronger center section, such as wood or metal, with additional apertures in the opposing side walls in the areas which lay between the support members 34 for access by the fork-lift tines.

The entirety of the pallet 10 of FIGS. 1*a* and 1*b*, with the exception of the tape 118 (FIG. 4), is preferably constructed of corrugated paperboard. For example, Packaging Corporation of America's Power Ply ® type corrugated construction with its double-layered fluted medium. Packaging Corporation of America is located in Evanston, Ill. Another multi-layered fluted medium or multi-walled board construction may also be used for additional pallet stacking strength. Also, the weight of the corrugated paper can be varied to achieve the desired pallet strength.

Other materials may be used, in whole or in part, to form the pallet.

Assembly Of The Support Member

Figure 2:
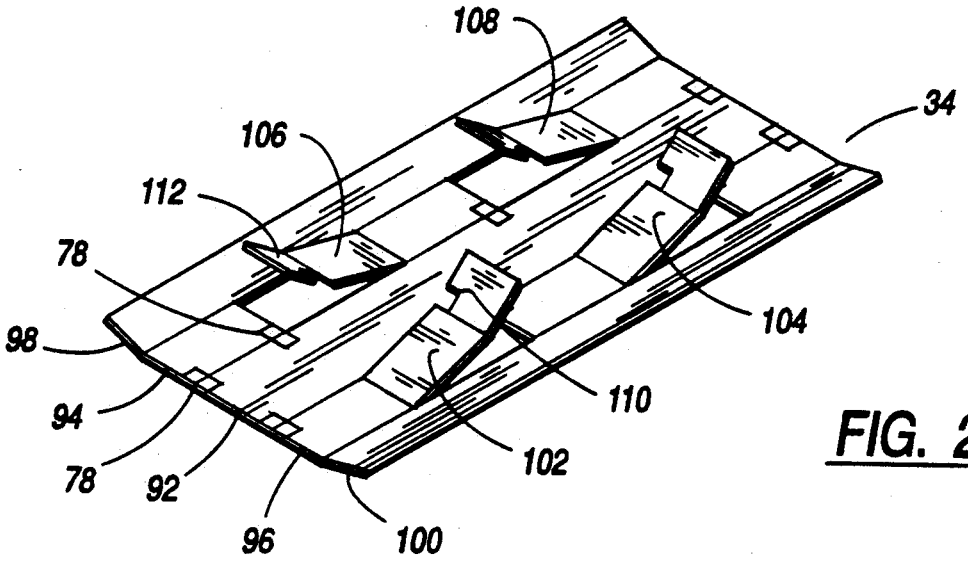
FIGS. 2 through 5 are drawings of a support member used in the pallet of FIGS. 1*a* and 1*b* and showing the steps of constructing the support member before final assembly of the pallet of FIGS. 1*a* and 1*b*.
Figure 3:
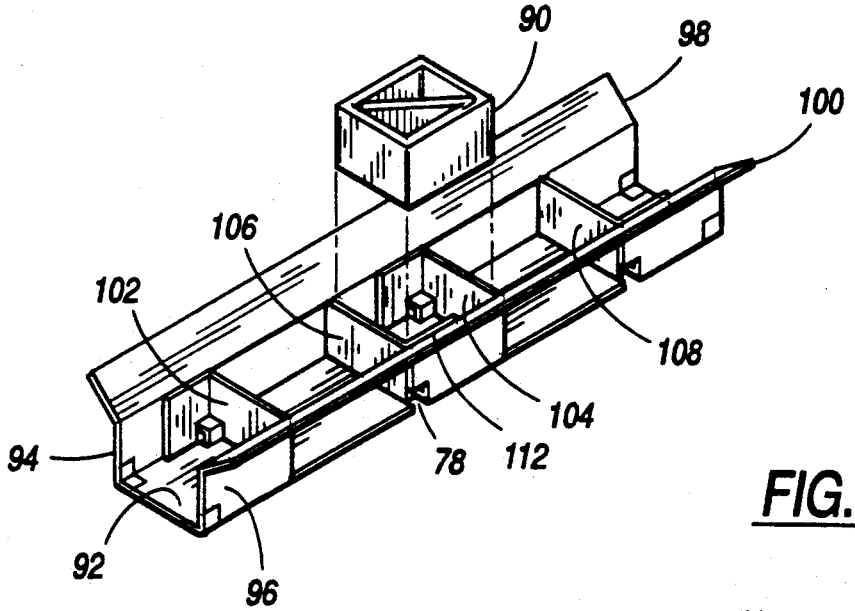
Figure 4:
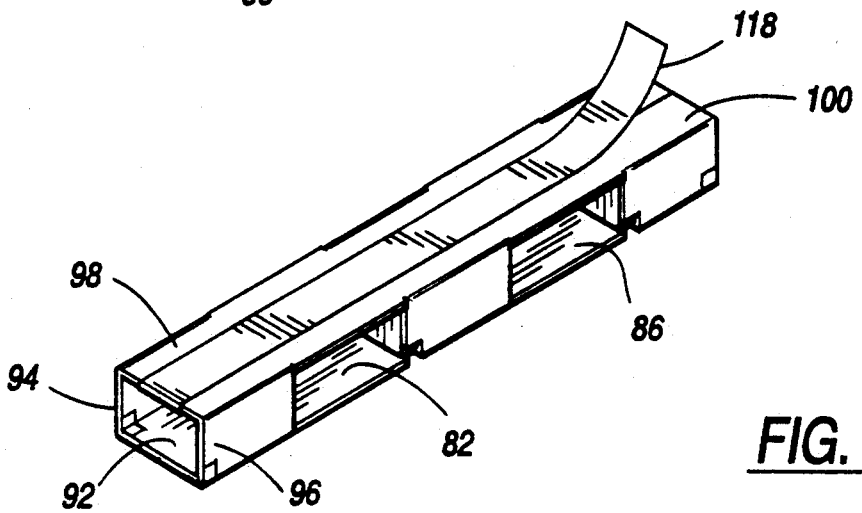

Referring now to FIGS. 2 through 4, a progressional illustration of the assembly of the support member 34 is illustrated.

The support members 34, which are shipped flat as shown in FIG. 2, include score lines to facilitate the formation of the elongated rectangular member shown in FIG. 4. The score lines define a center/bottom partition (or panel) 92, inner side partitions 94 and 96, and outside/top partitions 98 and 100.

Each of the inner side partitions 94 and 96 include two fold-back flaps 102, 104 and 106, 108. Each of these flaps is scored to fold back at a respective score line to provide an interior wall that is perpendicular to the plane in which the inner side partitions 94 and 96 lie.

These interior walls define the cavities 82 and 86 of FIG. 1*a*. Each of the fold-back flaps 102, 104 and 106, 108 includes a cut-out 110 to accommodate one of the fold-in tabs 78, and an end-portion 112 which is secured to the adjacent inner side partition 94 or 96 by positioning the cut-out 110 over the associated fold-in tab 78.

Using fold-back flap 106 as an example, end-portion 112 is folded and secured to inner side partition 96 by placing the cut-out 110 over the fold-in tab 78, as illlustrated in FIGS. 2 and 3.

Once the fold-back flaps 102, 104 and 106, 108 are in place and secure (with inner side partitions 94 upright as shown in FIG. 3), a support block 90 is inserted in the center of the support member 34. FIG. 3 illustrates this placement for the support block 90, which is secured in the center of the support member 34 by center/bottom partition 92, inner side partitions 94 and 96, outside/top partitions 98 and 100, and the tabs 78.

FIG. 4 illustrates the final assembly of the support member 34 once the block 90 is installed in its center. With the inner side partitions 94 and 96 upright, the outside/top partitions 98 and 100 are folded over to enclose the block 90. Conventional packaging tape 118 is then applied over the top of support member 34 to secure the outside/top partitions 98 and 100 to one another.

Figure 5:
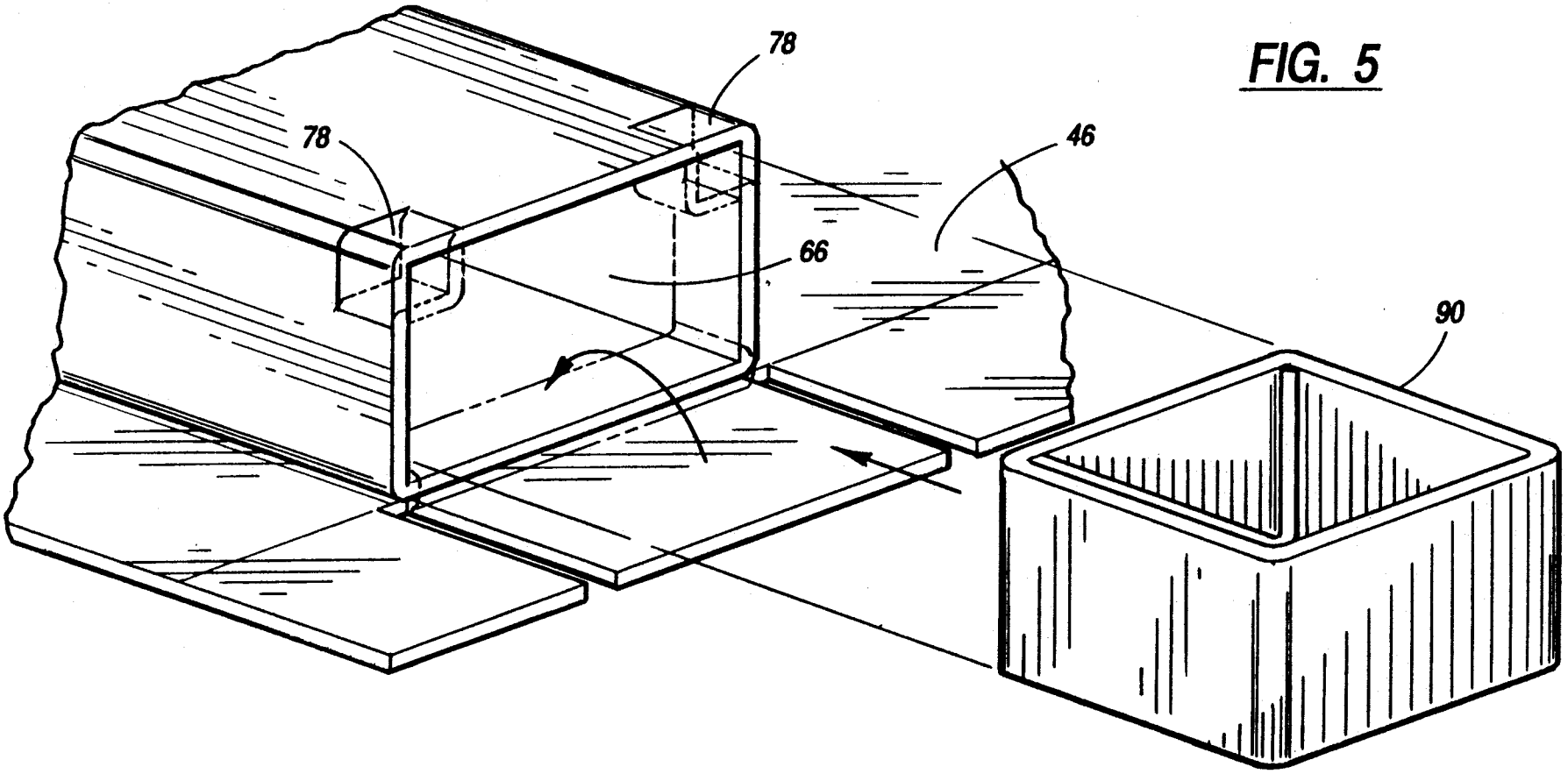

Next, support blocks 90 are prepared for insertion into the aperture ends of the support member 34, as shown in FIG. 5. First, the support members 34 are positioned on the bottom surface 46 of the base member 14 to properly align the support members 34 onto the base member 14. After the support members 34 have been positioned onto the base member 14, the ends 54 and 58 of the support member, and specifically sidewalls 66 and 70, are aligned with sides 18 and 22 of the base member 14.

At each end of the support member 34, the aperture 62 or 66 is prepared for receiving the support block 90 by pulling back the fold-in tabs 78. The flaps 30 on each of the sides 18 and 22 are then folded inwardly through the apertures 62 and 66 in the support members 34 to secure the support members 34 to the base member 14. The block 90 is then inserted into the aperture 62 or 66, as shown in FIG. 5, and the fold-in tabs 78 are returned to their inward position.

If the end pieces 38 are present on the base member 14, they are folded upward and wing members 42 also extend into the apertures 62 and 66 on support members 34*a* and 34*c* before the blocks 90 are inserted into the ends of the support member 34, thereby further securing the support members 34*a* and 34*c* to the base member 14.

Finally, the optional reinforcing member 93 can be inserted into cavities 82 and 86 to provide added strength to the support members 34, as previously discussed. If the end pieces 38 are present on the base member, the reinforcing member 93 is inserted into the cavities 82 and 86 prior to folding the end piece 38 upward and folding the wing members 42 into the apertures 62 and 66 in the support members 34.

Once the pallet is thus assembled, the pallet is turned over so that the support members 34 are resting on the floor or other surface. Thus, any materials that need to be stored or moved can then be placed onto the pallet 10 for storage, movement or any other desired purpose.

Conclusion

The pallet thus described has many advantages over previous pallets which are constructed of wood or plastic or other materials. The instant pallet is less expensive to manufacture than prior pallets and, therefore, less expensive to ship considering its lighter weight. Further, these pallets can be stored in a flat position prior to their assembly so as to reduce storage space. These pallets may also be entirely assembled by the user and there will be no possibility of damage to products being stored or moved on the pallet from wood splinters as with current wooden pallets. Finally, the pallets of the present invention are completely recyclable and the pallet strength can be easily altered through the us of different paper weights and different materials for the support blocks.

While the invention has been particularly shown and described with reference to certain embodiments, it will be recognized by those skilled in the art that modifications and changes may be made to the present invention without departing from the true spirit and scope thereof, which is set forth in the claims that follow.

What is claimed is:

1. A fiberboard pallet comprising:

a base member having a top surface and a bottom surface interconnected by a first edge and a second edge opposing the first edge;

a plurality of elongated fiberboard support members disposed adjacent a bottom surface of said base member and extending between the first and second edges of the base member, each of said support members having first and second ends, the first and second ends extending between and being disposed adjacent to the respective first and second edges of the base member; and interlocking means including a set of flaps and a set of apertures, one of said sets being disposed at the first and second ends of each of said support members and the other of said sets being positioned and connected at the opposing edges of said base member, said set of flaps engaging with said set of apertures to interlock the support members to the base member.

2. A pallet, according to claim 1, wherein said support member further includes a support block positioned in each of said first and second apertures.

3. A pallet, according to claim 2, wherein said support member further includes tab means adjacent to said aperture to secure said support block in said aperture.

4. A corrugated paperboard pallet comprising:

a base member having a top surface and a bottom surface interconnected by first and second opposing edges of the base member, and a plurality of flaps connected to and extending from the first and second opposing edges;

a plurality of elongated corrugated paperboard support members extending between said first and second opposing edges of said base member, each support member having first and second opposing ends extending between and disposed adjacent to the respective first and second opposing edges of said base member and arranged in parallel to one another on one of said surfaces of the base member; and each of said support members including aperture means at the first and second ends for receiving and securing an associated one of the plurality of flaps, thereby securing each of the support members to the base member.

5. A pallet, according to claim 4 wherein said flaps extend into said aperture means to secure said support members to the bottom surface of said base member.

6. The pallet of claim 5 wherein each of said support members further includes block members positioned in said aperture means.

7. The pallet of claim 6 wherein each of said support members further includes tab means adjacent said aperture means to secure said block members in said aperture means.

8. A pallet, according to claim 5, wherein each of said support members further includes a cavity positioned between said opposing ends.

9. A pallet, according to claim 8, further including a reinforcing member extending through said cavity.

10. A pallet, according to claim 8, wherein said cavity is constructed and arranged to receive tines from a fork lift.

11. A paperboard pallet comprising:

a base member having a top surface and a bottom surface interconnected by a first pair and a second pair of opposing edges;

at least three elongated paperboard support members, each of the support members secured to the bottom surface of said base member and extending from one edge to the other edge of the first pair of opposing edges, and each of the support members including opposing ends having apertures therein, the opposing ends extending between and disposed adjacent to respective opposing edges of the first pair of opposing edges; and flap means positioned and connected at the first pair of opposing edges said flap means extending into said apertures to secure the support members to the bottom surface of the base member.

12. A pallet, according to claim 11, further including first and second end pieces extending from said second pair at opposite edges, each of said end pieces having first and second ends each of which includes a wing member attached thereto for extending into an associated one of said apertures.

13. A pallet, according to claim 11, wherein each of said support members further includes a plurality of support blocks, at least one of which is positioned in one of said apertures.

14. A pallet, according to claim 13, wherein each of said support members further includes tab means adjacent said apertures to secure said support blocks in said apertures.

15. The pallet of claim 10 wherein each of said support members further includes a cavity positioned between said opposing ends.

16. A pallet, according to claim 15, further including a reinforcing member extending through said cavity.

17. An elongated support member means for supporting the bottom side of a base member to form a paperboard pallet, the bottom side of the base member being defined by two opposing edges, comprising:

a sheet of paperboard divided into a center partition and side partitions for folding into a rectangularly shaped column, the column constructed and arranged to support the bottom side of the base member from one edge to the other edge;

said side partitions including opposing ends and at least two sections which are cut to fold back to form respective walls which lay perpendicular to a plane in which the respective side partition lays; and interlocking means, located adjacent each opposing end of said side partitions, for interlocking the folded sheet of paperboard to the bottom side of the base member at each opposing end.

18. An elongated support member, according to claim 17, wherein the folded sheet of perpendicular includes opposing ends having apertures therein for engaging said interlocking means, and means for receiving support blocks secured between the side partitions.

* * * * *